United States Patent [19]

Heckler et al.

[11] Patent Number: 4,793,442

[45] Date of Patent: Dec. 27, 1988

[54] METHOD AND APPARATUS FOR PROVIDING PRE-TRAVEL BALANCING ENERGY TO AN ELEVATOR DRIVE

[75] Inventors: Mark K. Heckler, Ebikon, Switzerland; Larry V. Birney, Toledo, Ohio

[73] Assignee: Schindler Elevator Corporation, Toledo, Ohio

[21] Appl. No.: 117,621

[22] Filed: Nov. 5, 1987

[51] Int. Cl.[4] ..... B66B 1/44

[52] U.S. Cl. ..... 187/115; 187/131

[58] Field of Search ..... 187/115, 131

[56] References Cited

U.S. PATENT DOCUMENTS

| | | | |
|---|---|---|---|
| 1,003,913 | 9/1911 | Kilcoyne | 187/131 X |
| 1,862,603 | 6/1932 | McNaught | 187/131 |
| 2,604,782 | 7/1952 | Rissler et al. | 187/131 X |
| 2,886,137 | 5/1959 | Lund et al. | 187/131 |
| 3,244,957 | 4/1966 | Spiess et al. | 187/115 X |
| 3,486,101 | 12/1969 | Rufli | 187/115 X |
| 3,847,251 | 11/1974 | Maltby et al. | 187/115 |

FOREIGN PATENT DOCUMENTS

| | | | |
|---|---|---|---|
| 1083260 | 9/1967 | United Kingdom | 187/131 |

*Primary Examiner*—William M. Shoop, Jr.
*Assistant Examiner*—W. E. Duncanson, Jr.
*Attorney, Agent, or Firm*—Willian Brinks Olds Hofer Gilson & Lione

[57] ABSTRACT

A method and apparatus for providing pre-travel energy to an electrical elevator drive includes a load cell assembly for sensing the actual suspended weight of an elevator car and its passengers and a microprocessor which utilizes logic subroutines to manipulate this load data and data from a distance tachometer and car mounted sensors. The subroutines include an initializing subroutine which determines the empty car weight and balancing torques at the limits of travel, a normalizing subroutine which normalizes this data and determines the actual weight of the car and passengers and a rope compensation subroutine which calculates the torque required to balance the weight of the cables suspended from the elevator car. From the foregoing data, the microprocessor provides a pre-travel electrical signal to the elevator drive which corresponds to the torque level required to maintain the elevator car stationary during the interval between release of the brake and application of drive pattern power.

32 Claims, 3 Drawing Sheets

METHOD AND APPARATUS FOR PROVIDING PRE-TRAVEL BALANCING ENERGY TO AN ELEVATOR DRIVE

BACKGROUND OF THE INVENTION

The invention relates generally to elevator control systems and more specifically to an electrical control system wherein load cells provide data regarding elevator car loading and a microprocessor provides a signal corresponding to the torque level required to maintain the elevator car stationary subsequent to release of the brake and prior to initiation of a trip drive sequence.

The automatic control of elevators through microprocessors of various sizes and complexities is well documented in the patent literature. Various subroutines based upon historic elevator loading, for example, may be utilized to assign elevators to specific floors and general upward and downward operational patterns to achieve optimum elevator utilization and minimum passenger delay. Systems generally intended to provide such features in multiple car installations are disclosed in U.S. Pat. Nos. 4,603,387, 4,591,985, 4,536,842, 4,452,341 and 4,427,095.

As a means of determining elevator loading on a real time basis, for achieving, among other goals, optimum utilization of elevator resources, entails determining on a weight basis the loading of individual elevator cars. Such loading is typically achieved for example, U.S. Pat. No. 4,330,836 teaches the use of transducers for sensing the actual weight of the passengers within an elevator car. U.S. Pat. No. 4,380,275 teaches the use of such passenger weight data as an input to a prioritizing elevator control system. Likewise, U.S. Pat. No. 4,623,041 teaches the use of such elevator car weight information to improve the acceleration and deceleration performance of the elevator car.

One of the most and possibly the most critical portion of a elevator trip is the moment between release of the brake and the beginning of ascent or descent. If drive torque is applied to the motor before the brake is released the elevator car will typically undergo a jerk or rapid acceleration when the hold back torque of the releasing brake is overcome by the drive torque of the motor. Such performance may vary from un-noticeable through unpleasant to unacceptable. Conversely, if drive power to the elevator motor is delayed until the brake is fully released, the car may momentarily translate up or down depending upon the relationship between the instantaneous car weight and the counterweight. When such translation is in the same direction as the controlled and driven direction of the elevator car, it may likewise vary from the un-noticeable to the mildly annoying. However, when such translation is in the opposite direction of the controlled and driven direction of the elevator car, such performance is generally viewed as disconcerting and unacceptable. Since the momentary free translation of the car will effectively be random, depending on the difference between the car loading and the counterweight, such pre-travel will likewise be random.

In view of the foregoing, it is apparent that even the brief interval between the release of the brake and the application of drive energy to an elevator motor demands consideration. The method and apparatus of the present invention is so directed.

SUMMARY OF THE INVENTION

The present invention relates to a method and apparatus for providing pre-travel energy to an electrical elevator drive during the interval between the release of the brake and the application of drive pattern power. As such, it includes a load cell assembly for sensing the actual suspended weight of an elevator car, its passengers and associated cables and a microprocessor which utilizes logic subroutines to manipulate real time load data and data from shaft mounted sensors. Though described herein in relation to an elevator system roped one-to-one, the hardware and subroutines of the present invention are suitable for and adaptable to elevator systems roped two-to-one.

The load cell assembly preferably includes three load cells having summed, parallel outputs which provide data representing the total weight of the elevator car, passengers and any suspended cables. In an elevator roped one-to-one, the load cell assembly is disposed in the upper framework of the elevator car and the three-load cells are disposed uniformly about the center of action of the cables.

Another data signal is provided by a distance pulse tachometer. The tachometer may be coupled to the car overspeed governor and generates a signal representing the instantaneous position of the car.

Positioned at appropriate locations along the height of the elevator shaft corresponding to each floor or landing, are elongate vanes which are sensed by a pair of sensors secured to the elevator car. The sensors and vanes provide information to the microprocessor relating to the position of the elevator car and ensure accurate leveling at each landing.

The microprocessor includes various subroutines which receive load data from the load cells and elevator car position data from the tachometer and floor vane sensors and ultimately provide an electrical signal which represents the level of torque or electrical energy required by the elevator drive motor to maintain the elevator car stationary during the interval between the release of the brake and the application of drive pattern power.

A first subroutine defines a learning process which initializes the system. The subroutine is commenced at the first floor wherein confirmation is made that the car is proximate the first floor landing. First, the empty elevator car is weighed and this data is stored. Then, an empirically selected value of electrical power is applied to the drive motor corresponding to the estimated torque required to maintain the empty elevator car stationary at the first floor. The tachometer is utilized to sense whether the car is drifting upwardly or downwardly. The subroutine then decrements or increments the amount of electrical energy provided to the drive motor until the car remains stationary. This torque (energy) value is also stored. As a safety feature, if this balance is not achieved within the length of the floor vane, the subroutine stops the initializing process.

Upon achieving load or torque balance at the first floor, the elevator car is driven to the top floor of the building where it again repeats the subroutine by sensing the total weight of the empty car and suspended cables and performing the drift operation to determine that level of torque and corresponding electrical energy which maintains the car stationary in an unloaded condition at the top floor of the building. The subroutine then interpolates between these lower and upper data points and prepares a weight versus position relationship which applies to the entire elevator shaft.

A second subroutine utilizes this data to provide a normalized load range for sensing the weight of passengers within the elevator car which is independent of the elevator shaft position, i.e., is insensitive to the variable loading caused by the elevator cables. This normalized load range is utilized to provide a signal representative solely of the passenger load.

Next, the microprocessor includes a program which adds to the normalized passenger load a cable (rope) compensation factor. The cable compensation factor dynamically varies as the elevator car travels the elevator shaft and is based upon the position of the car and data stored during the initializing subroutine.

Finally, the microprocessor utilizes the initial first floor torque data, the passenger weight data, the rope compensation factor and counterweight data to generate a signal which will hold the elevator car stationary during the interval between release of the brake and the application of drive pattern power.

Thus it is an object of the present invention to provide an elevator control system which provides a pre-travel signal which renders the elevator car stationary during the interval between the release of the brake and the application of drive pattern power.

It is a further object of the present invention to provide an elevator control system having subroutines which sense the lowest floor and highest floor elevator car weights and provide a straight-line function therebetween.

It is a still further object of the present invention to provide an elevator control system wherein the actual weight of an elevator car, passengers and suspended cables are weighed by an assembly load cells.

Further objects and advantages of the present invention will become apparent by reference to the following description of the preferred embodiment and appended drawings.

DESCRIPTION OF THE PREFERRED EMBODIMENT

Figure 1:
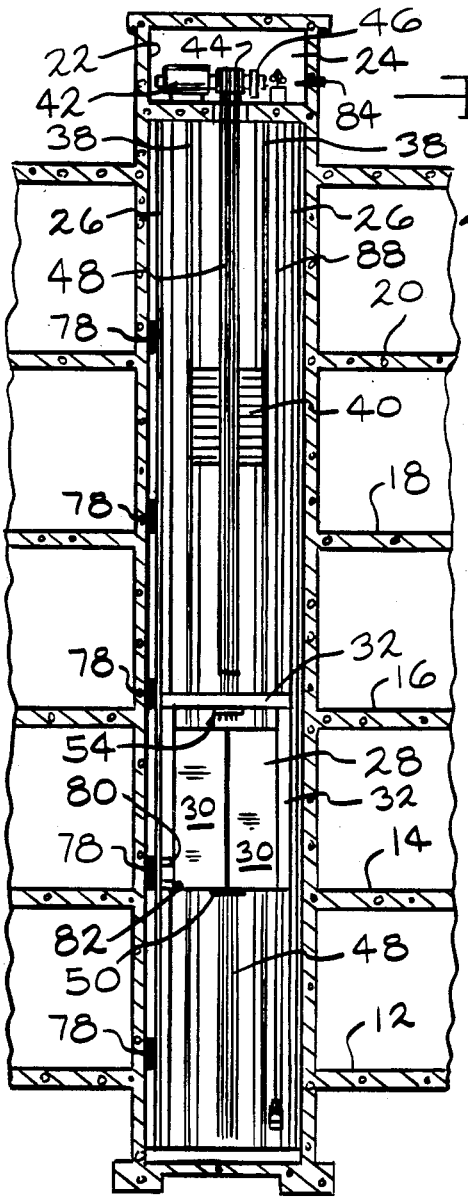
FIG. 1 is a fragmentary sectional view of an elevator installation in a five-story building according to the present invention.
Figure 3:
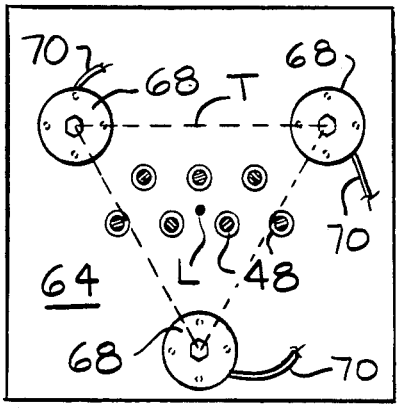
FIG. 3 is a full sectional view of a load cell assembly taken along line 3—3 of FIG. 2.
Figure 2:
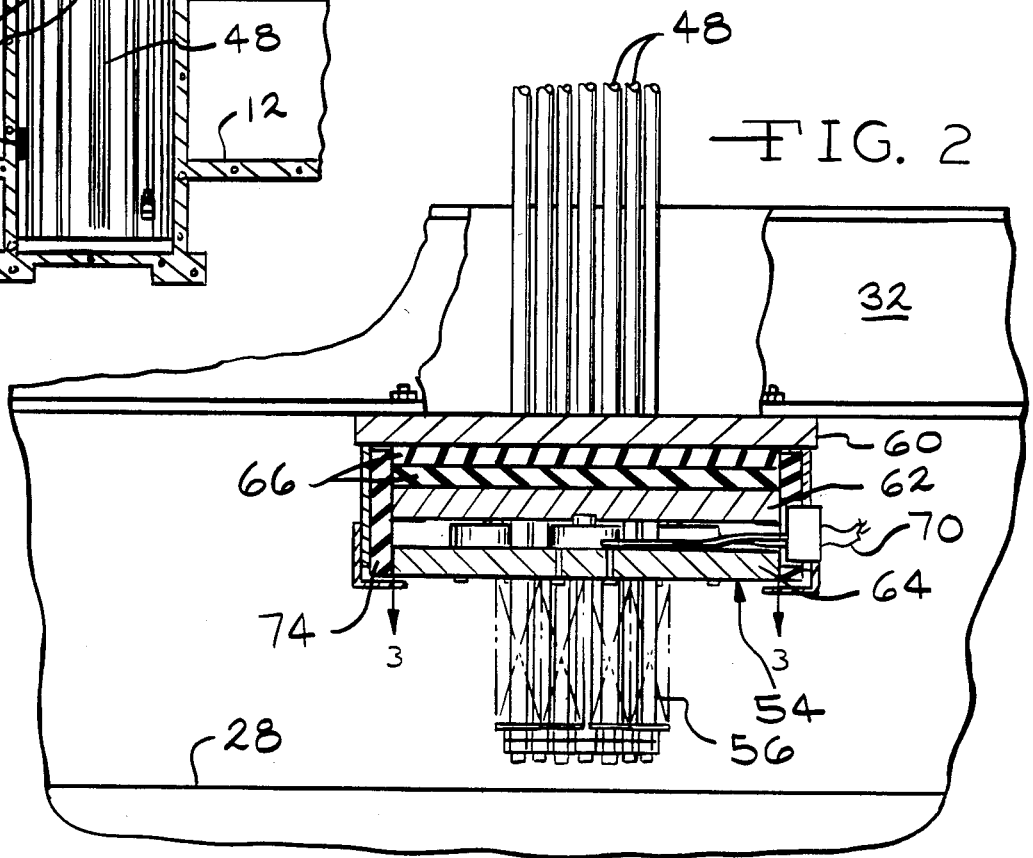
FIG. 2 is a fragmentary sectional view of the upper portion of an elevator car frame, suspension cables and load cell assembly according to the present invention.

Referring now to FIG. 1, a multiple story building is illustrated and generally designated by reference numeral 1. The multiple story building 1 is typical and representative of buildings having elevators such as an elevator control system 10 according to the present invention installed therein. The building 1 includes a first floor 12, a second floor 14, a third floor 16, a fourth floor 18 and a fifth floor 20. Extending vertically between the fist floor 12 and the fifth floor 20 is an elevator shaft 22 which terminates in an equipment room 24 vertically aligned above the elevator shaft 22. At the outset, it should be understood that the illustrated building 1 and elevator shaft 22 are illustrative and exemplary only and that the elevator control system 10 according to the present invention is both suitable for and intended for buildings having fewer as well as significantly greater numbers of floors and installations encompassing several elevators which may be linked to a common traffic measuring and responsive car assignment control system.

Secured to the walls of the elevator shaft 22 and extending from the floor of the equipment room 24 downwardly to the bottom of the elevator shaft 22 are two pairs of rails. A first pair of rails 26 secured to opposed sidewalls of the elevator shaft 22 receive complementary tracking components of an elevator car 28. The elevator car 28 is conventional and typically includes a pair of mechanically operable doors 30 which provide access to the interior of the elevator car 28. The elevator car 28 may also include a second pair of doors (not illustrated) on the back face of the elevator car 28, if desired. The car 28 is enclosed by a suitable frame 32 which may be fabricated of steel I-beams or similar structural components which are welded together or secured by other suitable fastening means.

Secured to the rear wall of the elevator shaft 22 is a second pair of rails 38 which extend from the floor of the equipment room 24 to the bottom of the elevator shaft 22 and slidably receive and guide a counterweight assembly 40. In accordance with conventional practice, the weight of the counterweight assembly 40 is preferably equal to the weight of the elevator car 28 plus between 40% and 50% of the total passenger weight capacity of the elevator car 28. As those familiar with elevator operation will appreciate, the weight of the counterweight assembly 40 is chosen to balance, on a long term average, the anticipated passenger loading of the elevator car 28. An often selected value in this range is 43% of the passenger capacity plus the weight of the car 28.

A conventional electric elevator drive motor 42 is mounted within the equipment room 24 and drives a sheave 44. The sheave 44 is also coupled to an electrically activated, fail-safe brake assembly 46. The sheave 44 receives and drives a plurality of ropes or cables 48. The cables 48 are secured to the counterweight assembly 40 and continue downwardly along the rear wall of the elevator shaft 22 where they hang in a loop and return upwardly to the bottom of the elevator car 28 where they are secured in a suitable terminating structure 50. The other set of ends of the cables 48 are coupled through appropriate terminating components through a load cell assembly 54 to the frame 32 of the car 28. A compression spring 56 is interposed between the end o each of the cables 48 and the load cell assembly 54.

The load cell assembly 54 includes a first, upper plate 60, a second, intermediate plate 62 and a third, lower plate 64. Disposed between the first and second plates 60 and 62, respectively are layers of a resilient, elastomeric, e.g., rubber, cushioning material 66. The cables 48 pass freely through the first plate 60, the second plate 62 and the cushioning material 66. Disposed between the second intermediate plate 62 and third, lower plate 64 are three load cells 68. The load cells 68 are conventional Wheatstone bridge type load cells and are identical. The load cells 68 are preferably disposed in an equilateral triangle, T, at uniform distances from the vertical line of action, L, of the forces applied to the third, lower plate 64 by the cables 48 through the compression springs 56. Each of the load cells 68 includes a multiple conductor cable 70 through which the output of the load cell 68 is provided to an amplifier 72 illustrated in FIG. 4. The amplifier 72 is preferably mounted a short distance from the load cell assembly 54, for example, on the frame 32 of the elevator car 28. The output of the amplifier 72 is preferably a current output which is carried by cables (not illustrated) from the elevator car 28 to, for example, the equipment room 24. The load cell assembly 54 also includes vertically extending elastomeric retainers 74 which encircle the components of the load cell assembly 54 and laterally restrain them.

Secured to the frame 32 of the elevator car 28 in operable relationship with a plurality of vanes 78 are a pair of sensors including a first, upper sensor 80 and a second, spaced-apart, lower sensor 82. The sensors 80 and 82 may be of either an optical or magnetic sensing configuration.

Secured to one of the walls of the elevator shaft 22 generally adjacent the path of the car 28 are the plurality of vanes 78. There are a equal number of vanes 78 and floors serviced by the elevator car 28. The vanes 78 are just slightly longer than the distance between the upper sensor 80 and the lower sensor 82 and are disposed at positions relative to the floors 12 through 20 such that when a vane 78 is engaged or sensed by both of the sensors 80 and 82, the floor of the elevator car 28 is level with the corresponding building floor 12, 14, 16, 18 or 20. Proximity to a given building floor 12, 14, 16, 18 or 20, either above or below, is determined when only one of the sensors 82 or 80, respectively, senses the associated vane 78.

A car overspeed governor assembly 84 may also be installed in the equipment room 22. The governor assembly 84 includes a distance pulse tachometer 66 which is driven by a cable 88 attached to the elevator car 28. The distance tachometer 86 provides a signal which may be a series of pulses or other output, such as a variable voltage, related to the distance traveled by the elevator car 28. The signal or pulses may be readily counted by known means to provide a data signal representing the instantaneous position of the elevator car 28.

Figure 4:
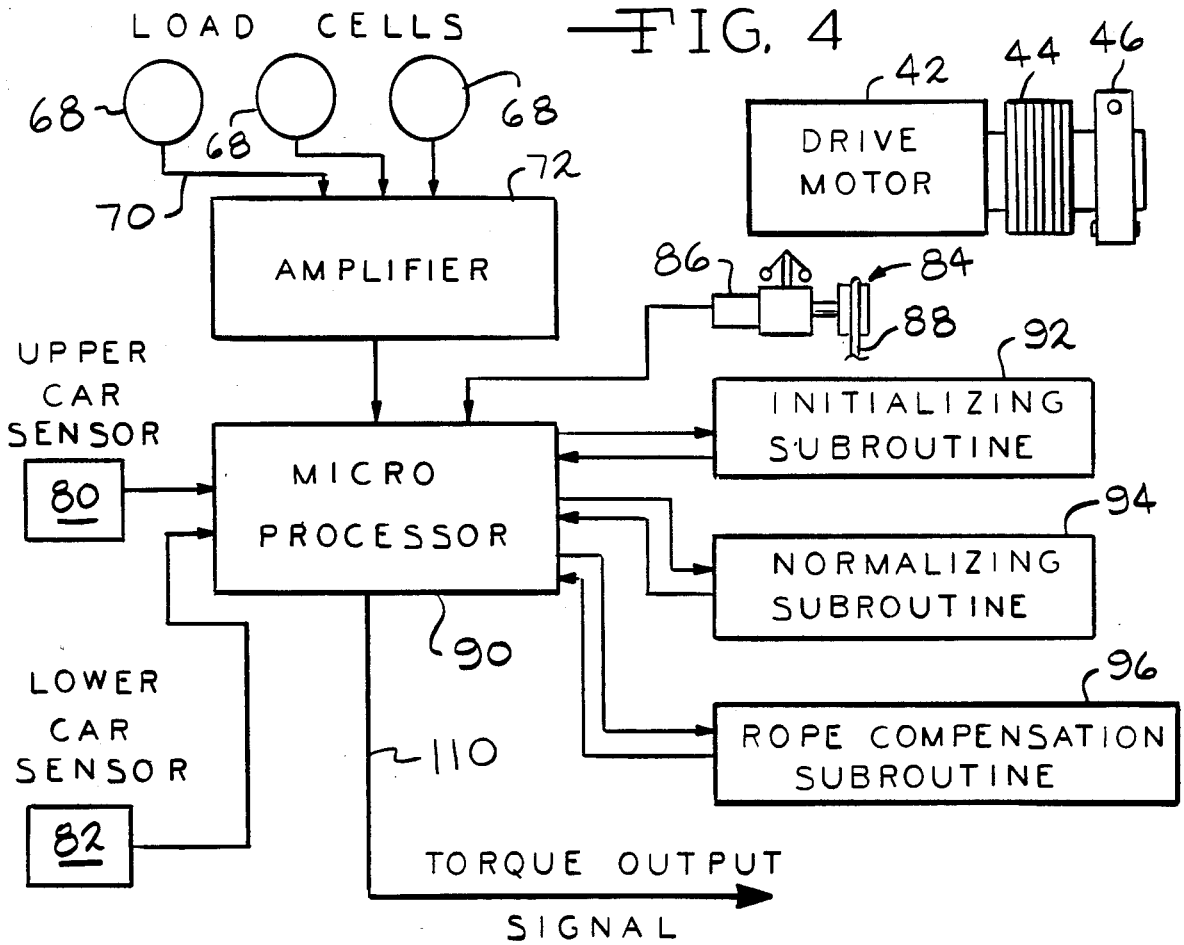
FIG. 4 is a diagrammatic view of an elevator control system according to the present invention.

Referring now to FIG. 4, a microprocessor 90 receives a current signal from the amplifier 72 representing the sum of the signals from the three load cells 68 in the load cell assembly 54. By applying the current output of the amplifier 72 to a fixed resistance (not illustrated), a variable voltage corresponding to the current applied to the resistor is provided. This variable voltage is the signal utilized by the microprocessor 90. The microprocessor 90 also includes inputs which receive the signals from the upper car sensor 80, the lower car sensor 82 and the distance tachometer 86.

Available to the microprocessor 90 and providing an integral portion of the operation of the elevator control system 10 are three subroutines. An initializing subroutine 92 establishes operating parameters upon the start-up of the elevator system 10. A normalizing subroutine 94 provides certain operating range characteristics and a rope compensation subroutine 96 corrects the sensed weight of the elevator car 28 in accordance with the initializing data to compensate for the added, suspended weight due to the elevator cables 48 at any given vertical position of the car 28. These data and the subroutines 92, 94 and 96 are combined, as will be more fully described subsequently, to provide a signal which when applied to circuitry providing an electrical drive signal to the drive motor 42 produces a drive motor torque which just balances the weight of the elevator car 28, passengers and suspended cables 48 so that the elevator car 28 remains stationary during the interval between the release of the brake assembly 46 and the application of drive pattern power to the drive motor 42.

The microprocessor 90, generally speaking, senses, operates and provides data signals in two distinct modes: the first relates to actual drive motor torques which are sensed, recorded and supplied in order to precisely balance the elevator car 28 under varying load conditions and at various positions along the elevator shaft 22 and the second relates to the actual weight sensed by the load cell assembly 54 of the elevator car 28, passengers and suspended cables 48.

Figure 5:
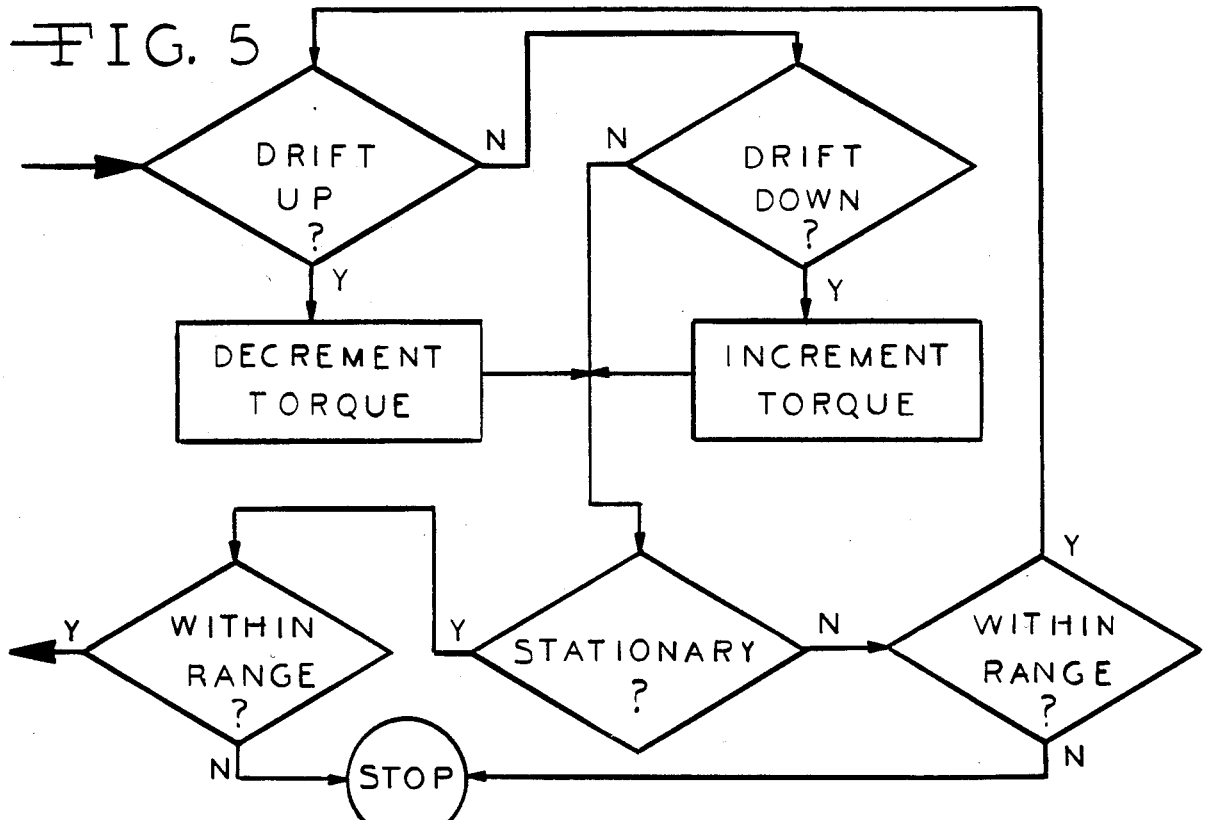
FIG. 5 is a flow chart of the initializing subroutine of the elevator control system according to the present invention.

The initializing subroutine 92 is one such subroutine which utilizes both of these data regions. When the operation of the elevator system 10 begins, the system 10 undergoes a learning process which invokes the initializing subroutine 92. The elevator car 28 is moved to the first floor 12 of the building 22 such that the sensors 80 and 82 both engage the first floor vane 78. The memory of the microprocessor 90 then records the sensed value of the actual empty car 28 provided by the load cell assembly 54 and the amplifier 72. The microprocessor 90 then enters the initializing subroutine 92 flow chart illustrated in FIG. 5 in order to determine the actual value of torque required to maintain the empty elevator car 28 stationary at the first floor 12. An empirical value of torque is selected and supplied to the drive motor 42 which, through experience, is believed to provide substantially stationary positioning of the elevator car 28. Ascending or descending motion of the elevator car 28 is sensed by the distance tachometer 86. If the elevator car 28 drifts up, the torque is decremented and, conversely, if the elevator car 28 drifts down, the torque is incremented. If the car is stationary, meaning that the empirical torque value is, in fact, the actual value required to maintain the car 28 stationary, and, at least one of the sensors 80 or 82 indicates that the car 28 is still proximate the level of the first floor 12, this torque value, designated TQR or reference torque, is recorded in the memory of the microprocessor 90 and the first transit of the initializing subroutine 92 illustrated in FIG. 5 is completed. The actual weight of the elevator car 28 and any suspended cables 48 is also recorded at this time. This weight is represented by the point 100 in the graph of FIG. 6.

If the elevator car 28 and the incrementing and decrementing sequence of the initializing subroutine 92 does not achieve balance and cease translation of the elevator car 28 before the elevator car 28 and both of the sensors 80 and 82 move away from the vane 78, the program is halted, manually adjusted and restarted. This stop feature is primarily a safety feature in order to avoid excess motion of the elevator car 28 under the control of the initializing subroutine 92 which might result in damage to various components of the elevator installation.

Upon completion of the initializing subroutine 92 at the first floor 12 of the building 1, the elevator car 28 ascends to the top floor of the building 1, in the example given in FIG. 1, the fifth floor 20. The initializing subroutine 92 is once again entered and the drift of the elevator car 28 is sensed by the distance tachometer 86.

Once again, if the car 28 drifts upward, the torque, that is, the energy supplied to the drive motor 42 is decremented and if the car 28 drifts downward, the torque supplied by the drive motor 42 is incremented. This routine is repeated according to the flow chart until the car 28 is stationary and within the range of the vane 78 on the fifth floor 20 and at least one of the sensors 80 or 82. At this time the value of torque required to maintain the elevator car 28 in a stationary position at the fifth floor 20 as well as the actual weight of the elevator car 28 and associated hanging cables 48 as measured by the load cell assembly 54 are recorded within the memory of the microprocessor 90. The weight of the elevator car 28 at this location is represented by a point 102 on the graph of FIG. 6.

Figure 6:
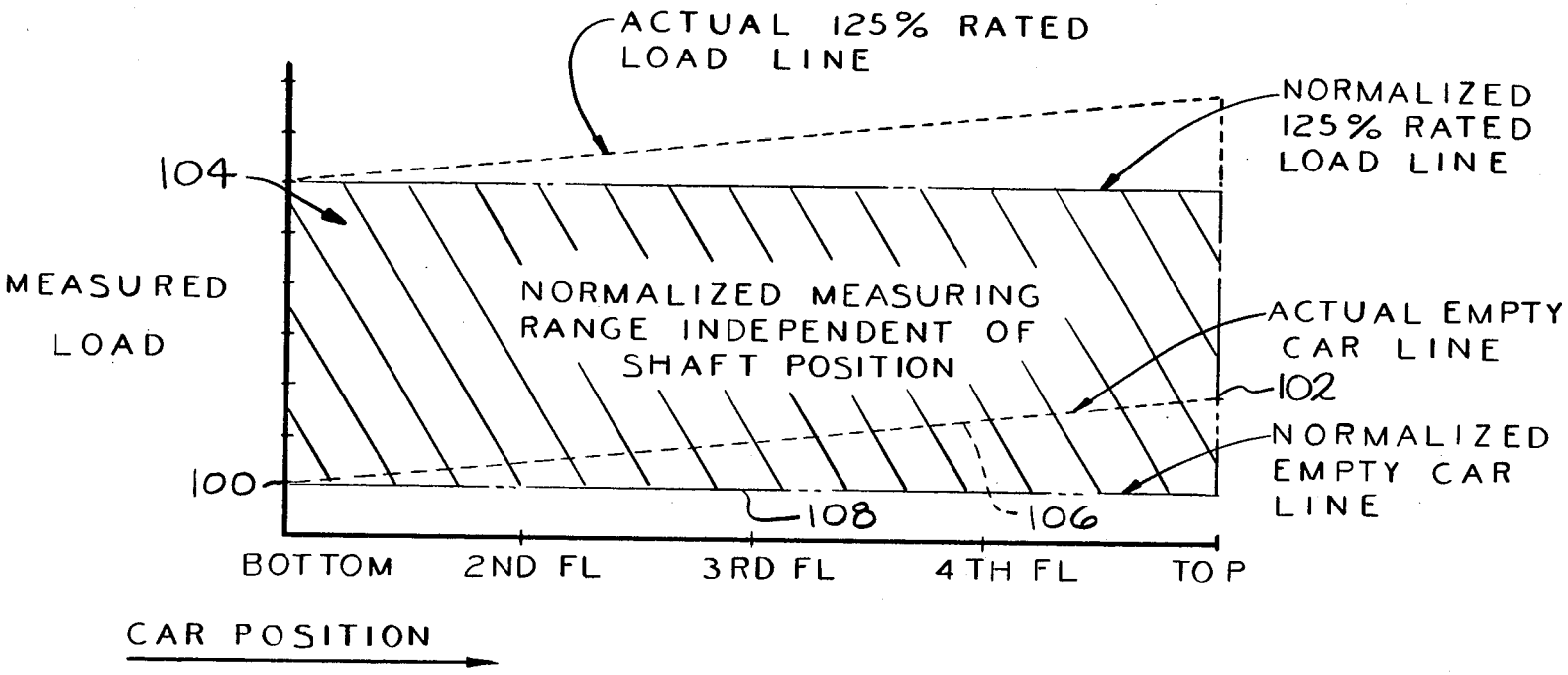
FIG. 6 is a graph of the initialized and normalized load measuring ranges of an elevator control system according to the present invention.

To summarize with reference to FIG. 6, the point 100 represents the actual measured load of an empty car 28 at the bottom of the elevator shaft 22, that is, at the first floor 12 and the point 102 represents the actual measured load of the empty car 28 at the top of the elevator shaft, that is, at the fifth floor 20. The difference in measured load between the points 100 and 102 represents the additional weight resulting from the increased length of cables 48 suspended from the elevator car 28 when it is at the fifth floor 20 relative to that suspended weight of cables 48 at the first floor 12.

The normalizing subroutine 94 utilizes the actual measured load of the empty car 28 as determined by the terminal points 100 and 102 to produce an inverse function which normalizes this data in order to provide an operating region which is independent of the position of the elevator car 28 within the elevator shaft 22. This normalized region is illustrated by the shaded area 104 within the graph of FIG. 6. The normalizing subroutine 94 first utilizes the equation:

$$COMP = \frac{MLTB \cdot (SACT - SBOT)}{TDIS}$$

where

COMP=Empty Car Load Compensation
MLTB=Difference in Measured Load between Top and Bottom of Elevator Shaft 22
SACT=Actual Position of the Elevator Car 28
SBOT=Bottom Position of the Elevator Car 28
TDIS=Total Length of Elevator Shaft 22.

The first portion of the normalizing subroutine 94 thus utilizes the weight difference of the elevator car 28 represented by the end points 100 and 102 to establish by interpolation the dashed line 106 along which the elevator car 28, in effect, translates in accordance with its position sensed by the distance tachometer 86.

In order to produce the normalized load range illustrated as area 104, the COMP signal is used in a negative sense, in effect, generating a line which is a mirror image of the dashed line 106 about the horizontal line 108, thereby compensating for the change in measured load due to the changing weight of the suspended cables 48. The empty weight of the elevator car 28 is also subtracted from the measured weight in order to improve resolution of the loaded weight of the elevator car 28. Inasmuch as the weight of the elevator car 28 is, and is assumed to be, a constant, such subtraction of its weight is, strictly speaking, not necessary. However, if the load measuring data range is restricted to a relatively narrow bandwidth, subtracting the weight of the elevator car 28, will improve the resolution of passenger weight.

The microprocessor 90 and specifically the normalizing subroutine 94 also performs the following calculation:

$$LDNR = LDMS - COMP - WTCR$$

where

LDNR=Normalized Load
LDMS=Measured Load
COMP=Empty Car Compensation Function
WTCR=Weight of Elevator Car 28.

Thus, the load which is measured by the load cell assembly 54 is corrected by the normalizing subroutine 94 and the normalized load, LDNR, is indicative solely of the weight of the passengers in the elevator car 28 represented by the shaded area 104 in the graph of FIG. 6. While the load measuring range 104 includes elevator car 28 position data, the normalized load, data, LDNR, is independent of the position of elevator car 28 within the elevator shaft 22. It should be noted that LDNR, the normalized load data, may be shared with a multiple elevator supervisory control system to assign various car to various floors or modes of operation to most expeditiously handle building traffic.

Next, the microprocessor 90 calls upon the rope compensation subroutine 96 to provide a compensating value which represents the additional torque that must be supplied to the drive motor 42 at a given position of the elevator car 28 along the elevator shaft 22 to compensate for, that is, balance, the weight of the cable 48 suspended from the elevator car 28 at its present location. The rope compensation subroutine 96 equation is analogous to that of the first normalizing equation and is as follows:

$$RCMP = \frac{TQTB \cdot (SACT - SBOT)}{TDIS}$$

where

RCMP=Rope Compensation Factor
TQTB=Difference in Holding Torques between Top and Bottom of the Elevator Shaft 22
SACT=Actual Position of the Elevator Car 28
SBOT=Bottom Position of the Elevator Car 28
TDIS=Total Length of the Elevator Shaft 22.

Finally, the microprocessor 90 provides a signal in the line 110 which, through associated control and drive circuitry (not illustrated), provides electrical energy to the drive motor 42 of a magnitude sufficient to compensate for the varying weight of the elevator car 28 such that it remains stationary during that interval between the release of the brake assembly 46 and the of application drive pattern power to the drive motor 42.

This torque value is a function of the previously calculated and stored operating parameters determined by the above-described subroutines. Specifically, the equation which calculates the torque necessary to maintain the elevator car 28 stationary at the commencement of each trip is as follows:

$$TQS = TQR + \frac{|LDNR \cdot TQR|}{CTW} + RCMP$$

where

TQS=Torque Necessary to Hold the Elevator Car 28 Stationary
TQR=Reference Torque Level
LDNR=Normalize Load in Elevator Car 28

CTW = Counterweight Value

RCMP = Rope Compensation Factor.

In order to understand the rationale of his equation, it is necessary to appreciate that all previous subroutines and equations have analyzed the operation of the elevator system 10 to determine isolated data which is utilized, for example, through interpolation, to normalize and operate with subsequently sensed data to produce real time operating parameters. One aspect of operation and specifically one component of the operation which has not entered into such calculations is the counterweight 40.

As noted previously, in an actual installation, the weight of the counterweight 40 is chosen to be between 40% and 50% of the passenger weight capacity of the elevator car 28 plus the weight of the elevator car 28 itself. In operation, when the total weight of passengers in the elevator car 28 and the weight of any suspended cables 48 is less than the weight of the counterweight 40, the elevator car 28 will attempt to ascend. Conversely, if the total weight of the passengers, elevator car 28 and suspended cables 48 is greater than the weight of the counterweight 40, the elevator car 28 will attempt to descend. Thus, both the magnitude and the direction of the torque provided by the drive motor 42 to maintain the car 28 stationary, or move it up or down, for that matter, depends upon the loading of the car 28. For example, in an elevator system 10 in which the counterweight 40 is sized to equal 43% of the load capacity of the elevator car 28 and the weight of the elevator car 28, when the weight of the passengers in the elevator car 28 is equal to such 43% load capacity, the second term of the above equation will drop out and the reference torque, TQR, is adjusted only by the rope compensation factor RCMP to obtain the stationary torque value, TQS.

In the following two examples, it will be assumed that the counterweight value is 50% of the weight of the elevator car 28 and its total capacity which will assumed to be 3,000 pounds. In a first example, it will be assumed that the elevator car 28 is empty. Thus, the equation becomes:

$$TQS = -50 + \frac{|0 \cdot (-50)|}{50} + RCMP$$

The second term of the equation drops out and the torque required to maintain the car stationary is the referenced torque which is the holding torque at the first floor 10 determined by the initializing subroutine 9. Thus, the stationary torque, TQS, equals the reference torque, TQR, plus the rope compensation factor RCMP.

If the passenger weight in the elevator car 28 increases to 1,500 pounds which is one half the capacity of the car 28, the equation becomes:

$$TQS = -50 + \frac{|50 \cdot (-50)|}{50} + RCMP$$

Here, the first and second terms cancel out such that the torque required to maintain the elevator car 28 stationary is only a function of the rope compensation term. By extension, if the passenger weight in the elevator car 28 is above the 50% capacity level, the TQS term will become positive meaning that the drive motor 44 must provide lifting torque to maintain the elevator car 28 stationary inasmuch as the car 28 now weighs more than the counterweight 40.

In the foregoing examples, the numerical values are values adapted to function with certain existing control systems. The actual numerical values and ranges may thus be different from those utilized above in order to adapt and function with various other control schemes. The equations and calculations set forth above, however, will remain unchanged. Thus, it should be appreciated that those values given are explanatory and illustrative and are neither limiting nor defining.

When the system 10 is operating it should be understood that weighing of the elevator car 28 is repeatedly undertaken, that is, at least once per trip. A preferable time for such weight measurement is at the time the elevator doors 30 commence closing for the last time. A this point, no additional passengers will enter the elevator car 28 and a short interval exists before the elevator car 28 commences motion which is sufficient time in which to carry out the specified computations. This is in contrast to the operation of the initializing subroutine 92 which is intended for use only when the system 10 is initially placed in service. Of course, the steps of the initializing subroutine 92 may be repeated, as necessary, if the system 10 is readjusted, serviced, reprogrammed, rest, modified, etc.

Finally, it should be understood that the foregoing description has related to an elevator system roped one-to-one, that is, with the elevator car 28 and counterweight 40 roped directly over a single sheave 44 is illustrated in FIG. 1. The elevator system 10 and especially the subroutines of the microprocessor 90 are fully and completely adaptable to elevator systems roped two-to-one, that is, systems in which the cables 48 are secured at one end to a stationary load cell assembly 54 secured to the equipment room floor, looped through a sheave (not illustrated) on the top of the elevator car 28, routed over the drive sheave 44 in the equipment room 2 to the counterweight 40 and finally secured to the bottom of the elevator car 28. In a system roped two-to-one, the elevator car 28 translates one-half the distance traversed by the counterweight 40. In such a system, the slope of the line 106 may be either positive (as illustrated in FIG. 6) or negative. In either case, however, the points 100 and 102 will be established by the initializing subroutine 92 and the normalizing subroutine 94 and other elements of the system 10 will perform as described. Typically, with such an arrangement, the slope of the line will be less than in an installation roped one-to-one.

The foregoing disclosure is the best mode devised by the inventors for practicing this invention. It is apparent, however, that method and apparatus incorporating modifications and variations will be obvious to one skilled in the art of elevator control systems. Inasmuch as the foregoing disclosure is intended to enable one skilled in the pertinent art to practice the instant invention, it should not be construed to be limited thereby but should be construed to include such aforementioned obvious variations and be limited only by the spirit and scope of the following claims.

We claim:

1. An elevator control system comprising, in combination, means for measuring the total weight of an elevator car, passengers and suspended cables, means for storing the empty weight of said elevator at the lower and upper operating limits of said car, means for determining an energy input to a drive motor to maintain said car stationary at a lower and an upper operating limit of said car, means for providing an interpolation representative of the portion of said total weight of said elevator car resulting from said suspended cables, means providing a data signal representative of the weight of passengers in said elevator car, and means for determining an energy input level to said drive motor which maintains said elevator car substantially stationary.

2. The elevator control system of claim 1 wherein said means for measuring the total weight includes a plurality of load cells operatively disposed between cables suspending said elevator car and said elevator car.

3. The elevator control system of claim 1 wherein said means for storing is an electronic memory device.

4. The elevator control system of claim 1 wherein said means for providing an interpolation utilizes said empty weights of said elevator car in said storing means.

5. The elevator control system of claim 1 wherein said data signal represents only the weight of passengers in said elevator car.

6. The elevator control system of claim 1 wherein said means for determining an energy input level utilizes said interpolation and said data.

7. The elevator control system of claim 1 further including means for storing said energy input to said drive motor to maintain said car stationary at said lower operating limit.

8. The elevator control system of claim 7 wherein said means for determining an energy input level utilizes said interpolation, said data and information in said means for storing said energy input.

9. In an elevator system including an elevator car disposed for vertical translation in a shaft, an electric drive motor, a brake coupled to said motor, a counterweight disposed for translation in said shaft and cables coupling said car, said drive motor and said counterweight, the improvement comprising, means for measuring the total weight of said elevator car, passengers and cables suspended from said elevator car, means for storing said measured weight at a lower and an upper operating limit of said elevator car, means for determining and storing an energy input to said drive motor to maintain said elevator car stationary at said upper and lower operating limits of said car, means for normalizing said total measured weight to represent the weight of said passengers in said elevator car, and means for determining an energy input level to said electric drive motor which maintains said elevator car substantially stationary upon release of said brake.

10. The improvement of claim 9 wherein said means for measuring the total weight includes a plurality of load cells operatively disposed between cables suspending said elevator car and said elevator car.

11. The improvement of claim 9 wherein said means for normalizing includes means for providing an interpolation utilizing said measure weights in said means for storing.

12. The improvement of claim 9 wherein said means for normalizing provides a at a signal representative of only the weight of passengers in said elevator car.

13. The improvement of claim 9 wherein said means for determining an energy input level utilizes data from said normalizing means and both of said storing means.

14. A method of providing pre-travel balancing energy to an electric elevator drive motor comprising the steps of, measuring and storing the total weight of an elevator car and suspended cables and the lowest and highest floor levels in an installation, measuring and storing the energy necessary to maintain said elevator car and suspended cables stationary at said lowest and highest floor levels in an installation, utilizing said stored weight data to provide an interpolation signal representing the weight of said suspended cables, providing a data signal representative of the weight of passengers in said elevator car, generating a drive signal controlling said drive motor which maintains said elevator car substantially stationary.

15. The method of claim 14 further including the step of frequently measuring the total weight of said elevator car and suspended cables.

16. The method of claim 14 wherein said data signal represents only the weight of passengers in said elevator car.

17. The method of claim 14 wherein said generating means utilized the stored value of energy necessary to maintain said elevator car and suspended cables stationary at said lowest floor level, said interpolation and data representing the magnitude of a counterweight.

18. The method of claim 14 wherein said elevator car is maintained stationary in the interval between release of a brake and the application of drive pattern energy to said drive motor.

19. The method of claim 14 further including the step of measuring said total weight of said elevator car and said suspended cables at the beginning of each trip.

20. A load cell assembly for measuring the total weight of an elevator car including passengers and suspended cables comprising, in combination, an elevator car supported in a frame, a first plate, means for coupling said first plate to said frame, a plurality of cables, a second plate disposed below said first plate, means for coupling said plurality of cables to said second plate, and a plurality of load cells disposed between said first plate and said second plate.

21. The load cell assembly of claim 20 wherein said plurality of load cells includes at least three of said load cells.

22. The load cell assembly of claim 20 wherein said plurality of load cells includes three load cells arranged in an equilateral triangle about the line of action of said plurality of cables.

23. The load cell assembly of claim 20 wherein said means for coupling said plurality of cables to said second plate is a respective plurality of springs.

24. The load cell assembly of claim 20 wherein said means for coupling said first plate to said frame is a resilient material.

25. The load cell assembly of claim 20 wherein said load cells are disposed about the line of action of said plurality of cables.

26. A load cell assembly for measuring the total weight of an elevator car including passengers and suspended cables comprising, in combination, an elevator car supported in a frame, a first plate, means for coupling said first plate to said frame, a plurality of cables, a second plate disposed below said first plate, means for coupling said plurality of cables to said second plate, and three load cells disposed between said first plate and said second plate and arranged in a triangle about the line of action of said plurality of cables.

27. The load cell assembly of claim 26 wherein said triangle si equilateral and said line of action is equidistant from said three load cells.

28. The load cell assembly of claim 26 wherein said means for coupling said plurality of cables to said second plate is a respective plurality of springs.

29. The load cell assembly of claim 26 wherein said first plate includes a plurality of apertures for receiving a respective one of said plurality of cables and at least one planar face.

30. The load cell assembly of claim 26 wherein said second plate includes a plurality of apertures for receiving a respective one of said plurality of cables, and a pair of substantially parallel faces.

31. A load cell assembly for measuring the total weight of an elevator car including passengers and suspended cables comprising, in combination, an elevator car supported in a frame, said frame having a first load bearing surface, a plurality of cables, means disposed below said first load bearing surface having a second, opposed load bearing surface, means for coupling each of said plurality of cables to said just recited means, and three load cells disposed between said first and said second load bearing surfaces and arranged in a triangle about the line of action of said plurality of cables.

32. The load cell assembly of claim 31 wherein said coupling means is a respective plurality of springs and said load cells are equidistant from said line of action.

* * * * *